US011582551B2

(12) United States Patent
Wang et al.

(10) Patent No.: US 11,582,551 B2
(45) Date of Patent: Feb. 14, 2023

(54) SPEAKER DEVICE

(71) Applicant: Jabil Circuit (Singapore) Pte. Ltd., Singapore (SG)

(72) Inventors: Wen-Hong Wang, Taichung (TW); Chia-Chien Chen, Taichung (TW); Ching-Feng Lin, Taichung (TW); Po-Cheng Huang, Taichung (TW); Shih-Hsien Yang, Taichung (TW); Kuo-Lin Chao, Taichung (TW); Cheng-Chih Tai, Taichung (TW); Kuan-Yu Su, Taichung (TW); En-De Su, Taichung (TW); Cheng-Kun Chiang, Taichung (TW); Ke-Yu Lin, Taichung (TW); Ching-Hsin Chen, Taichung (TW)

(73) Assignee: Jabil Circuit (Singapore) Pte. Ltd., Singapore (SG)

( * ) Notice: Subject to any disclaimer, the term of this patent is extended or adjusted under 35 U.S.C. 154(b) by 0 days.

(21) Appl. No.: 17/509,458

(22) Filed: Oct. 25, 2021

(65) Prior Publication Data

US 2022/0141575 A1 May 5, 2022

(30) Foreign Application Priority Data

Nov. 4, 2020 (CN) ..... 202011216845.6

(51) Int. Cl.
*H04R 1/28* (2006.01)

(52) U.S. Cl.
CPC ..... *H04R 1/2834* (2013.01)

(58) Field of Classification Search
CPC ..... H04R 1/2815; H04R 1/2826; H04R 1/283
USPC ..... 381/349
See application file for complete search history.

(56) References Cited

U.S. PATENT DOCUMENTS

| | | | | |
|---|---|---|---|---|
| 4,301,332 A * | 11/1981 | Dusanek | H04R 1/2834 381/349 |
| 6,031,919 A | 2/2000 | Funahashi et al. | |
| 6,782,112 B1 * | 8/2004 | Geddes | H04R 1/2834 381/345 |
| 2008/0169150 A1 * | 7/2008 | Kuo | H04R 1/2826 181/155 |

FOREIGN PATENT DOCUMENTS

| | | |
|---|---|---|
| CN | 102395062 A | 3/2012 |
| JP | H04175098 A | 6/1992 |

* cited by examiner

*Primary Examiner* — Suhan Ni
(74) *Attorney, Agent, or Firm* — Young Basile Hanlon & MacFarlane, P.C.

(57) ABSTRACT

A speaker device includes a housing body, a speaker driver and a passive radiator. The housing body is formed with a first sound hole and a second sound hole respectively opening in two opposite directions. The speaker driver is disposed in the housing body, is located adjacent to the first sound hole, and is adapted to generate sound. The passive radiator is disposed in the housing body, is located adjacent to the second sound hole, and is adapted to generate sound. The first sound hole and the second sound hole are adapted for respectively allowing the sound generated by the speaker driver and the sound generated by the passive radiator to travel out from the housing body respectively in two opposite directions therethrough.

14 Claims, 9 Drawing Sheets

SPEAKER DEVICE

CROSS-REFERENCE TO RELATED APPLICATION

This application claims priority to Chinese Invention Patent Application No. 202011216845.6, filed on Nov. 4, 2020.

FIELD

The disclosure relates to a speaker device, and more particularly to a speaker device including a passive radiator.

BACKGROUND

With increasing adoption of augmented reality and virtual reality technologies by entertainment industry, head-mounted displays are being designed to be smaller and smaller in order to meet the market demand for portability, and so are conventional speaker devices on the head-mounted displays.

However, a relatively small size of the conventional speaker device may lead to poor low-frequency audio performance of the conventional speaker device. Furthermore, even though some conventional speaker devices may be equipped with a passive radiator to improve the low-frequency audio performance and to provide mounting position variations for a speaker driver thereof, phase cancellation that adversely affects the low-frequency audio performance may still occur.

SUMMARY

Therefore, an object of the disclosure is to provide a speaker device that can alleviate at least one of the drawbacks of the prior art.

According to the disclosure, the speaker device includes a housing body, a speaker driver and a passive radiator. The housing body is formed with a first sound hole and a second sound hole respectively opening in two opposite directions. The speaker driver is disposed in the housing body, is located adjacent to the first sound hole, and is adapted to generate sound. The passive radiator is disposed in the housing body, is located adjacent to the second sound hole, and is adapted to generate sound. The first sound hole and the second sound hole are adapted for respectively allowing the sound generated by the speaker driver and the sound generated by the passive radiator to travel out from the housing body respectively in two opposite directions therethrough.

According to another aspect of the disclosure, the speaker device includes a housing body, a speaker driver and a passive radiator. The housing body is formed with a first sound hole and a second sound hole, and includes two shell covers and a mounting base disposed between the shell covers. Each of the shell covers has a shell wall and a shell surrounding that extends from a periphery of the shell wall. The shell surrounding of one of the shell covers cooperates with the mounting base to define one of the first sound hole and the second sound hole. The first sound hole and the second sound hole respectively open in two opposite directions. The speaker driver is mounted to the mounting base, is located adjacent to one of the first sound hole and the second sound hole, and is adapted to generate sound. The passive radiator is mounted to the mounting base, is located adjacent to the other one of the first sound hole and the second sound hole, and is adapted to generate sound. The one and the other one of the first sound hole and the second sound hole are adapted for respectively allowing the sound generated by the speaker driver and the sound generated by the passive radiator to travel out from the housing body respectively in two opposite directions therethrough.

According to still another aspect of the disclosure, the speaker device includes a housing body, a speaker driver and a passive radiator. The housing body includes two shell covers. Each of the shell covers has a shell wall. The shell walls of the shell covers are respectively formed with a first sound hole and a second sound hole respectively opening in two opposite directions. The speaker driver is disposed in the housing body, is located adjacent to one of the first sound hole and the second sound hole, and is adapted to generate sound. The passive radiator is disposed in the housing body, is located adjacent to the other one of the first sound hole and the second sound hole, and is adapted to generate sound. The one and the other one of the first sound hole and the second sound hole are adapted for respectively allowing the sound generated by the speaker driver and the sound generated by the passive radiator to travel out from the housing body respectively in two opposite directions therethrough.

BRIEF DESCRIPTION OF THE DRAWINGS

Other features and advantages of the disclosure will become apparent in the following detailed description of the embodiments with reference to the accompanying drawings, of which.

DETAILED DESCRIPTION

Figure 1:
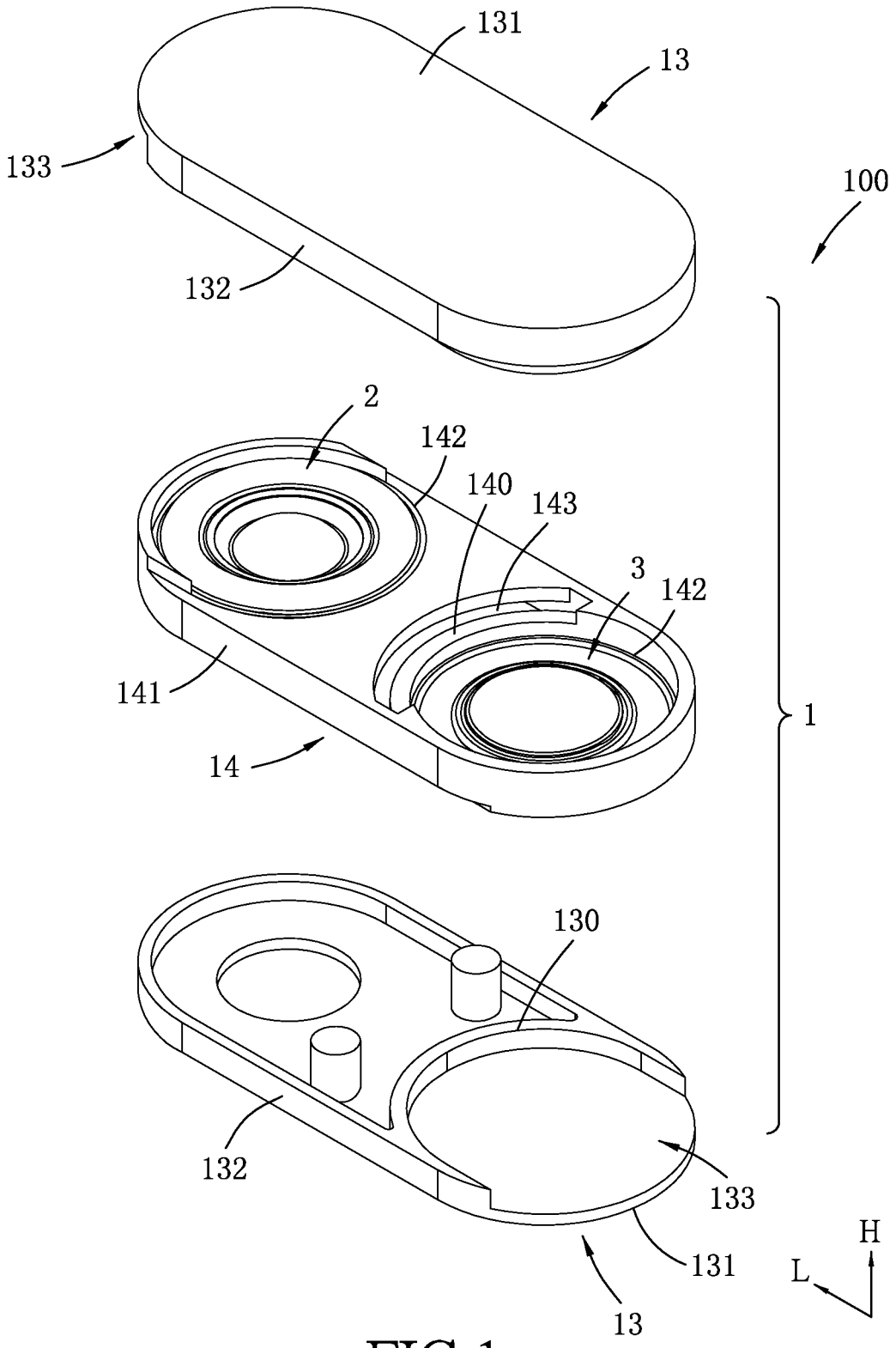
FIG. 1 is a partly exploded perspective view of a first embodiment of a speaker device according to the disclosure.

Before the disclosure is described in greater detail, it should be noted that where considered appropriate, reference numerals or terminal portions of reference numerals have been repeated among the figures to indicate corresponding or analogous elements, which may optionally have similar characteristics.

Figure 2:
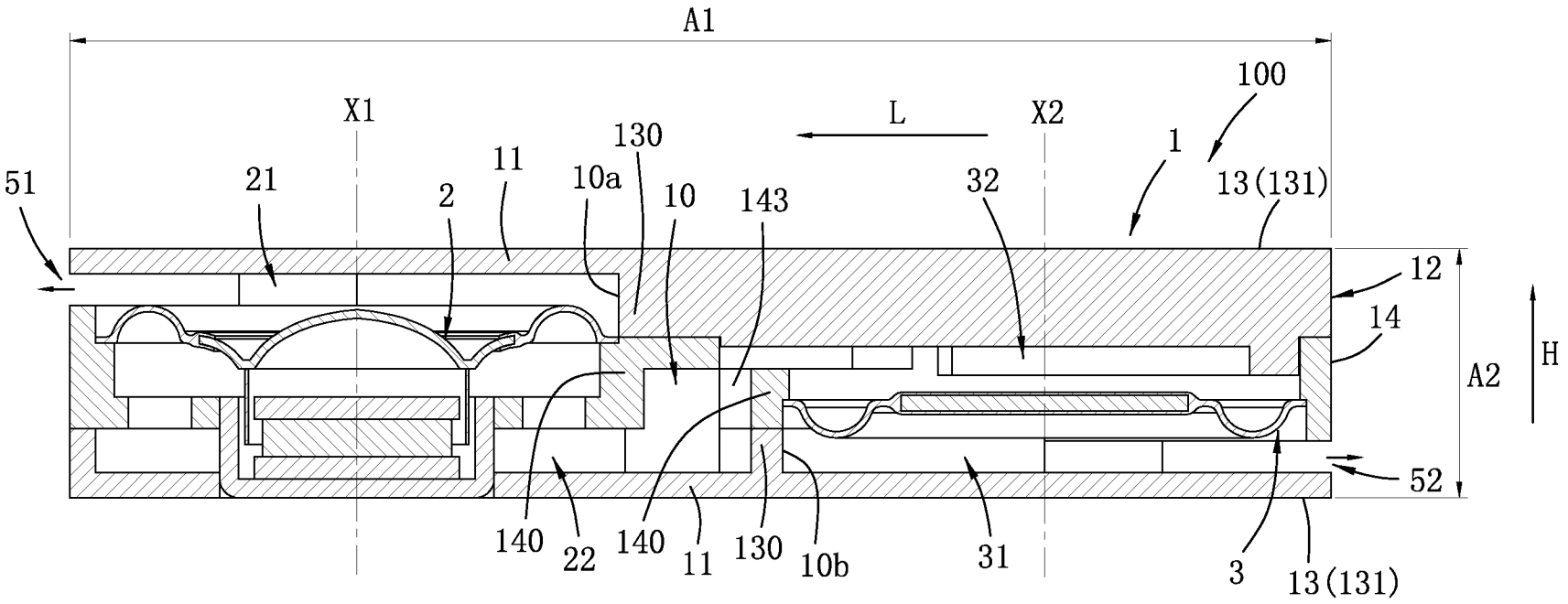
FIG. 2 is a sectional view of the first embodiment.

Referring to FIGS. 1 and 2, a first embodiment of a speaker device 100 according to the disclosure is adapted to be disposed on a head-mounted display (e.g., a pair of augmented reality smartglasses), and includes a housing body 1, a speaker driver 2 and a passive radiator 3. The housing body 1 is formed with a first sound hole 51 and a second sound hole 52 respectively opening in two opposite directions. The speaker driver 2 is disposed in the housing body 1, is located adjacent to the first sound hole 51, and is adapted to generate sound. The passive radiator 3 is disposed in the housing body 1, is located adjacent to the second sound hole 52, and is adapted to generate sound. The first sound hole 51 and the second sound hole 52 are adapted for respectively allowing the sound generated by the speaker driver 2 and the sound generated by the passive radiator 3 to travel out from the housing body 1 respectively in two opposite directions therethrough.

In the first embodiment, the housing body 1 is flat and elongated, and has two wall sections 11 and a surrounding section 12. The wall sections 11 are located at two opposite sides of the speaker driver 2 and the passive radiator 3. The surrounding section 12 surrounds the speaker driver 2 and the passive radiator 3, and interconnects the wall sections 11. The first sound hole 51 and the second sound hole 52 are formed at two opposite sides of the surrounding section 12 in a first direction (L). The housing body 1 includes two shell covers 13 and a mounting base 14 disposed between the shell covers 13 (the mounting base 14 is sandwiched between the shell covers 13). Each of the shell covers 13 has a shell wall 131 that is flat, and a shell surrounding 132 that extends from a periphery of the shell wall 131. The mounting base 14 is flat and elongated, and has a base surrounding 141 corresponding in position to the shell surroundings 132 of the shell covers 13. The shell walls 131 of the shell covers 13 respectively define the walls section 11, and the shell surroundings 132 of the shell covers 13 cooperate with the base surrounding 141 of the mounting base 14 to define the surrounding section 12. In the first embodiment, the housing body 1 has a longest dimension (A1) in the first direction (L) and a shortest dimension (A2) in a second direction (H). The longest dimension (A1) is no less than three times the shortest dimension (A2). Specifically, the longest dimension (A1) is a distance between two opposite ends of either one of the wall sections 11 in the first direction (L), and the shortest dimension (A2) is a distance between a surface of the shell wall 131 of one of the shell covers 13 which is opposite to the shell wall 131 of the other one of the shell covers 13 and a surface of the shell wall 131 of the other one of the shell covers 13 which is opposite to the shell wall 131 of the one of the shell covers 13. The second direction (H) is perpendicular to the first direction (L). By virtue of the proportion of the longest dimension (A1) to the shortest dimension (A2) of the housing body 1, the speaker driver 2 and the passive radiator 3 can remain well disposed in the housing body 1 even though the housing body 1 may be relatively small since the speaker device 100 has to be adapted to fit the size of a head-mounted display.

In the first embodiment, the shell surrounding 132 of each of the shell covers 13 is formed with an opening 133. By virtue of the openings 133, the shell surroundings 132 cooperate with the mounting base 14 to respectively define the first sound hole 51 and the second sound hole 52 (i.e., the openings 133 are located at the opposite sides of the surrounding section 12 in the first direction (L)). The speaker driver 2 is circular and has a central axis (X1) extending in a direction perpendicular to the direction in which the sound that is generated by the speaker driver 2 travels through the first sound hole 51. The passive radiator 3 is circular and has a central axis (X2) extending in a direction perpendicular to the direction in which the sound that is generated by the passive radiator 3 travels through the second sound hole 52. Specifically, in the first embodiment, the sound generated by the speaker driver 2 travels through the first sound hole 51 in the first direction (L), and the sound generated by the passive radiator 3 travels through the second sound hole 52 in the direction opposite to the first direction (L). The central axes (X1, X2) of the speaker driver 2 and the passive radiator 3 are parallel to each other and extend in the second direction (H).

The mounting base 14 of the housing body 1 is indented with two mounting sections 142 spaced apart from each other in the first direction (L), and is formed with a through channel 143 interconnecting the mounting sections 142. The speaker driver 2 and the passive radiator 3 are respectively mounted to the mounting sections 142, and face the shell covers 13 of the housing body 1, respectively. The one of the shell covers 13 that is faced by the speaker driver 2 cooperates with the speaker driver 2 to define a front speaker space at a front side of the speaker driver 2, and cooperates with the passive radiator 3 to define a rear radiator space 32 at a rear side of the passive radiator 3. The other one of the shell covers 13 that is faced by the passive radiator 3 cooperates with the speaker driver 2 to define a rear speaker space 22 at a rear side of the speaker driver 2, and cooperates with the passive radiator 3 to define a front radiator space 31 at a front side of the passive radiator 3. The front speaker space 21 and the front radiator space 31 communicate with the external environment through the first sound hole 51 and the second sound hole 52, respectively. The rear speaker space 22 and the rear radiator space 32 communicate with each other through the through channel 143.

The housing body 1 defines a first disposing space 10*a* at which the speaker driver 2, the front speaker space 21 and the rear speaker space 22 are located, a second disposing space 10*b* at which the passive radiator 3, the front radiator space 31 and the rear radiator space 32 are located, and a through space 10. In the first embodiment, each of the shell covers 13 further has a cover partition wall 130 being closer to the opening 133 of the shell cover 13 and having two opposite ends that are connected to the shell surrounding 132, and the mounting base 14 further has two mounting partition walls 140 respectively being adjacent to the mounting sections 142 thereof and respectively corresponding in position to the cover partition walls 130 of the shell covers 13. The housing body 1 defines the first disposing space 10*a* by the shell walls 131 of the shell covers 13, one of the mounting partition walls 140 and the corresponding one of the cover partition walls 130, and defines the second disposing space 10*b* by the shell walls 131, the other one of the mounting partition walls 140 and the other corresponding one of the cover partition walls 130. In certain embodiments, the first disposing space 10*a* and the second disposing space 10*b* may be defined only by the shell walls 131 and the mounting partitions walls 140, or only by the shell walls 131 and the cover partitions walls 130. A portion of the first disposing space 10*a* serves as a portion of the through space 10, and a portion of the second disposing space 10*b* serves as another portion of the through space 10. Specifically, the through channel 143 of the mounting base 14, the rear speaker space 22 (a portion of the first disposing space 10*a*) and the rear radiator space (a portion of second disposing space 10*b*) cooperatively serve as the through space 10 (i.e., the rear side of the speaker driver 2 faces the through space 10, and the rear side of the passive radiator 3 faces the through space 10). The through space 10 is located substantially between the speaker driver 2 and the passive radiator 3. In the first embodiment, a ratio of volume of the speaker driver 2 to that of the through space 10 ranges from 1:2 to 2:1.

Figure 3:
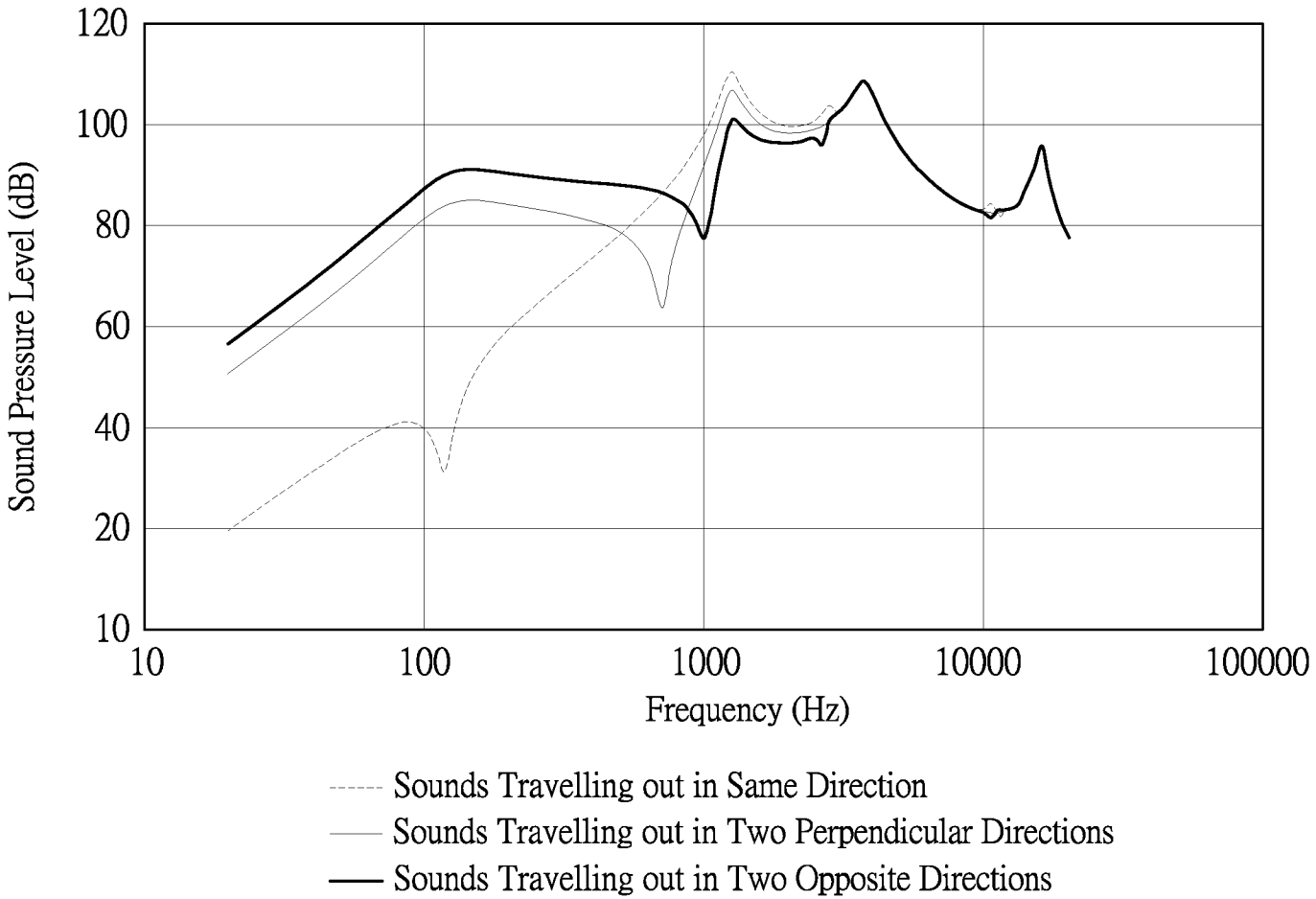
FIG. 3 is an equal-loudness contour illustrating different equal-loudness curves when sound generated by a speaker driver of the embodiment and sound generated by a passive radiator of the embodiment travel out from the embodiment in same direction (hidden line), in two perpendicular directions (thin line) and in two opposite directions (bold line)
Figure 4:
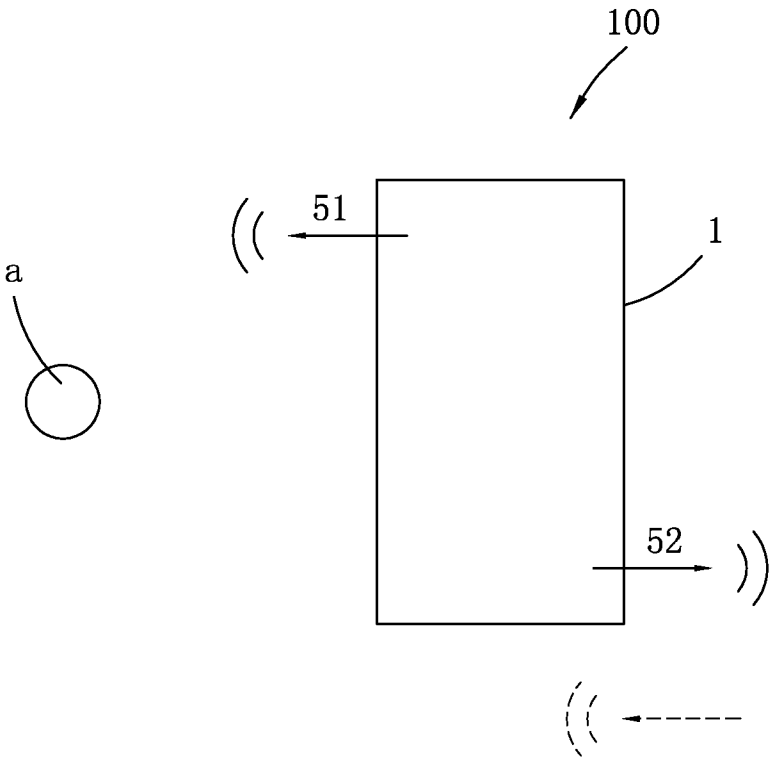
FIG. 4 is a schematic view illustrating how the sound generated by the speaker driver and the sound generated by the passive radiator travel relative to a listener.

Referring to FIG. 3, an equal-loudness contour in which three different equal-loudness curves are shown is used to explain the reason why the first embodiment adopts the first sound hole 51 and the second sound hole 52 of the housing body 1 that respectively open in the opposite directions. The different equal-loudness curves respectively represent audio performances of the first embodiment when the sound generated by the speaker driver 2 and the sound generated by the passive radiator 3 travel out from the housing body 1 in same direction (hidden line), in two perpendicular directions (thin line) and in two opposite directions (bold line). Generally, the passive radiator 3 is adapted to be driven by air at the rear side of the speaker driver 2 to generate the sound. Therefore, when the sound generated by the speaker driver 2 and the sound generated by the passive radiator 3 travel out from the housing body 1 in the same direction, the sound waves are 180 degrees out of phase so that phase cancellation (i.e., destructive interference) occurs, which leads to poor audio performance, especially for low-frequency sound (see a sharp drop from 1,000 Hz toward 10 Hz in the hidden-line curve). When the sounds travel out from the housing body 1 in the perpendicular directions, the audio performance is slightly improved, which is represented by the thin-line curve that falls more steadily than the hidden-line curve from 1,000 Hz toward 10 Hz. Referring further to FIG. 4, when the sounds travel out from the housing body 1 respectively through the first sound hole 51 and the second sound hole 52 respectively opening in the opposite directions, for a sound receiver (a) who is at one side of the housing body 1 opposite to the second sound hole 52 and who can only receive sound traveling toward him/her, the phase of the sound waves that travels through the second sound hole 52 has already been reversed (i.e., difference of 180 degrees) in the air when he/she receives it. Specifically, part of the sound that travels through the second sound hole 52 may experience reflection and then travel in the same direction (see the arrow drawn by a hidden line in FIG. 4) as the sound generated by the speaker driver 2, and the phase thereof is reversed after the reflection. Therefore, the sound waves that the sound receiver (a) receives are in phase Consequently, as shown in FIG. 3, by virtue of the first sound hole 51 and the second sound hole 52 respectively opening in the opposite directions, the low-frequency audio performance of the first embodiment is further improved, which is represented by the bold-line curve that is more steady than the thin-line curve, and the high-frequency audio performance of the first embodiment is not affected.

Figure 5:
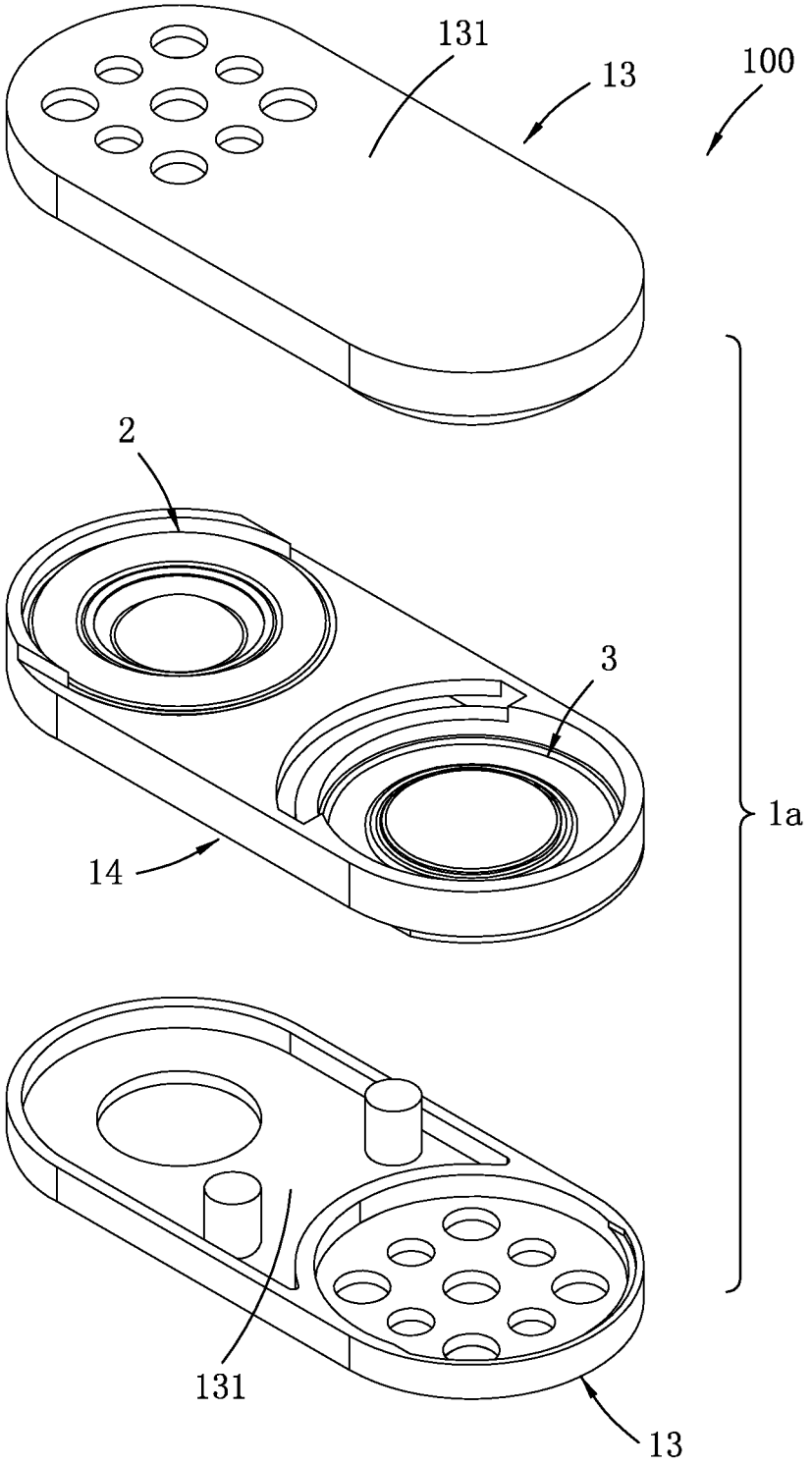
FIG. 5 is a partly exploded perspective view of a second embodiment of the speaker device.
Figure 6:
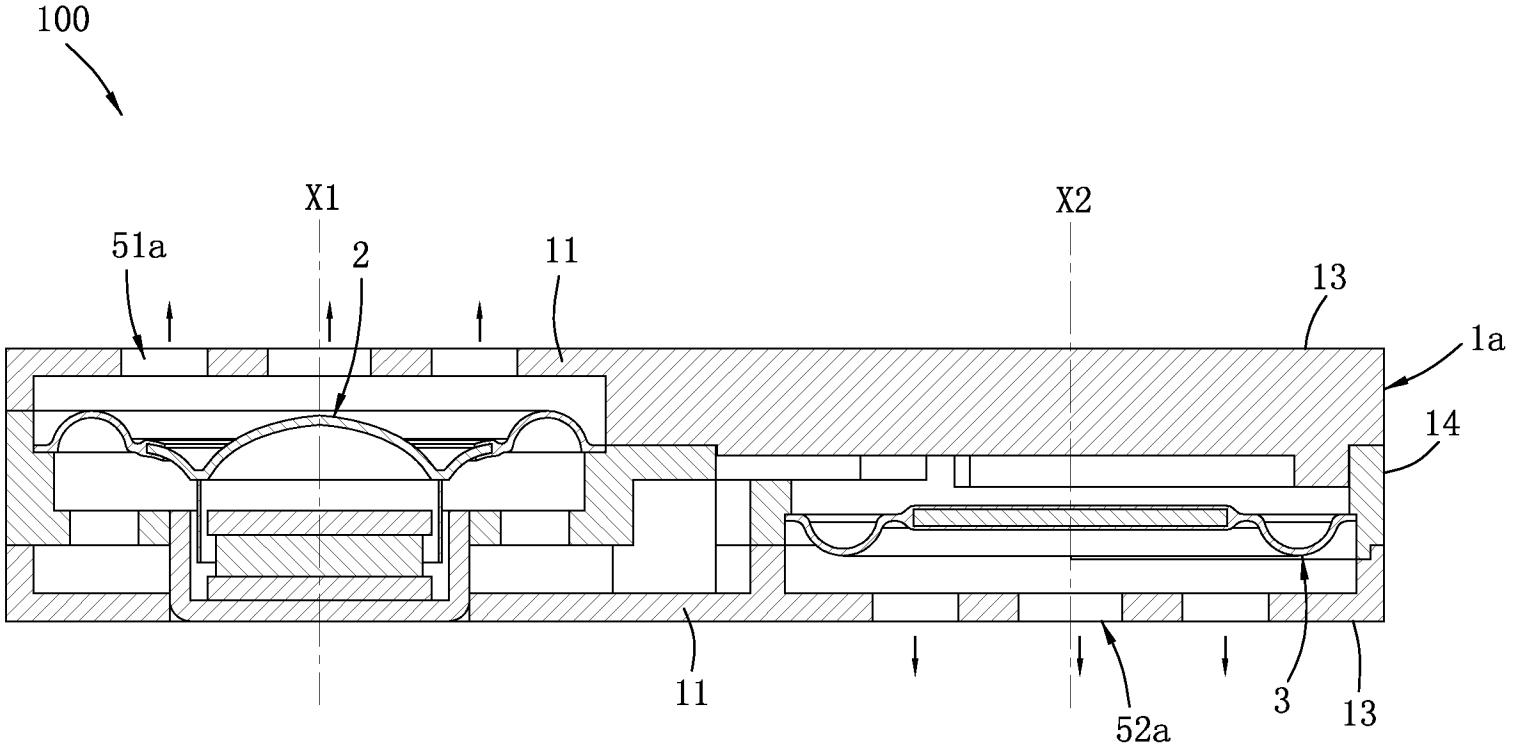
FIG. 6 is a sectional view of the second embodiment.

Referring further to FIGS. 5 and 6, a second embodiment of the speaker device 100 includes a different configuration of the housing body 1*a*, and has different configurations of the first sound hole 51*a* and the second sound hole 52*a*. In the second embodiment, the first sound hole 51*a* and the second sound hole 52*a* are respectively formed at the wall sections 11 of the housing body 1*a*. That is to say, the shell walls 131 of the shell covers 13 are respectively formed with the first sound hole 51*a* and the second sound hole 52*a*. It is noted that, as shown in FIG. 5, the number of the first sound hole 51*a* may be more than one, and so may that of the second sound hole 52*a*. With the configurations of the first sound hole 51*a* and the second sound hole 52*a*, the sound that is generated by the speaker driver 2 travels through the first sound hole 51*a* in a direction parallel to the direction in which the central axis (X1) of the speaker driver 2 extends, and the sound that is generated by the passive radiator 3 travels through the second sound hole 52*a* in a direction parallel to the direction in which the central axis (X2) of the passive radiator 3 extends.

Figure 7:
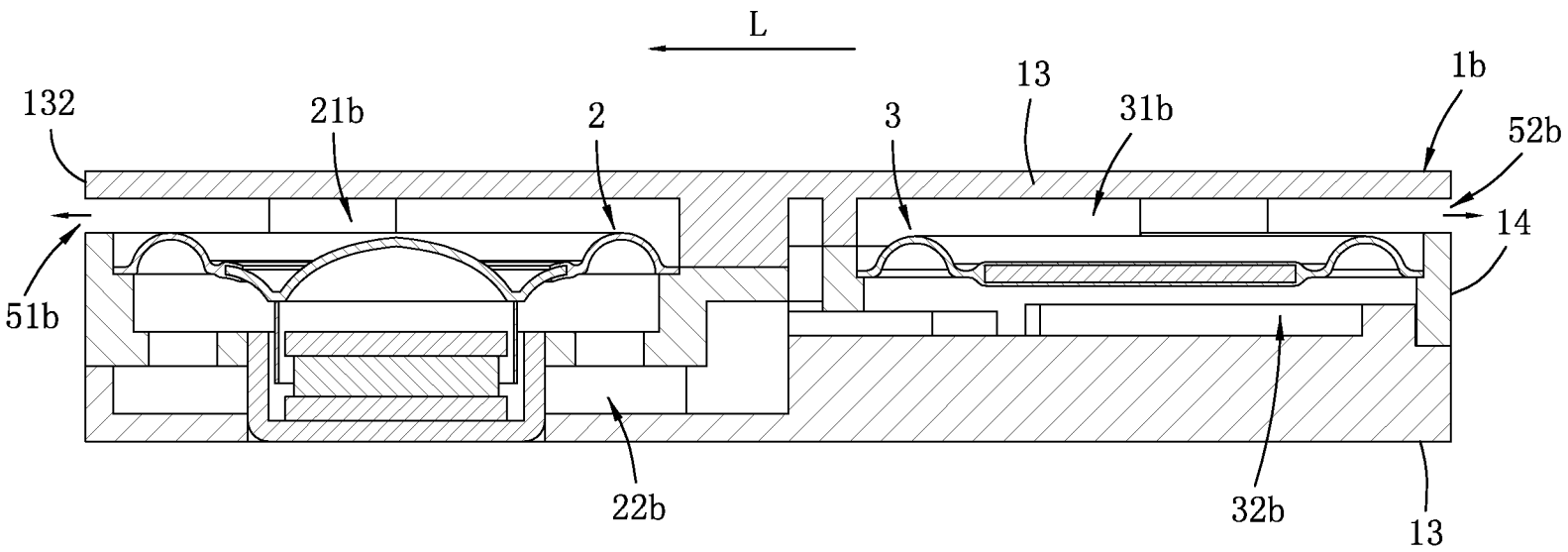
FIG. 7 is a sectional view of a third embodiment of the speaker device.

Referring further to FIGS. 7, a third embodiment of the speaker device 100 includes a different configuration of the housing body 1*b*, and has a different configuration of the second sound hole 52*b*. In addition, the speaker driver 2 and the passive radiator 3 in the third embodiment face the same one of the shell covers 13 of the housing body 1*b*. The shell surrounding 132 of the one of the shell covers 13 that the speaker driver 2 and the passive radiator 3 face is formed with two openings (with reference to the openings 133 in FIG. 1). By virtue of the openings, the shell surrounding 132 of the one of the shell covers 13 cooperates with the mounting base 14 to define the first sound hole 51*b* and the second sound hole 52 that open in two opposite directions. The speaker driver 2 and the passive radiator 3 respectively cooperate with the one of the shell covers 13 that they face to define the front speaker space 21*b* and the front radiator space 31*b*, and respectively cooperate with the other one of the shell covers 13 to define the rear speaker space 22*b* and the rear radiator space 32*b*.

Figure 8:
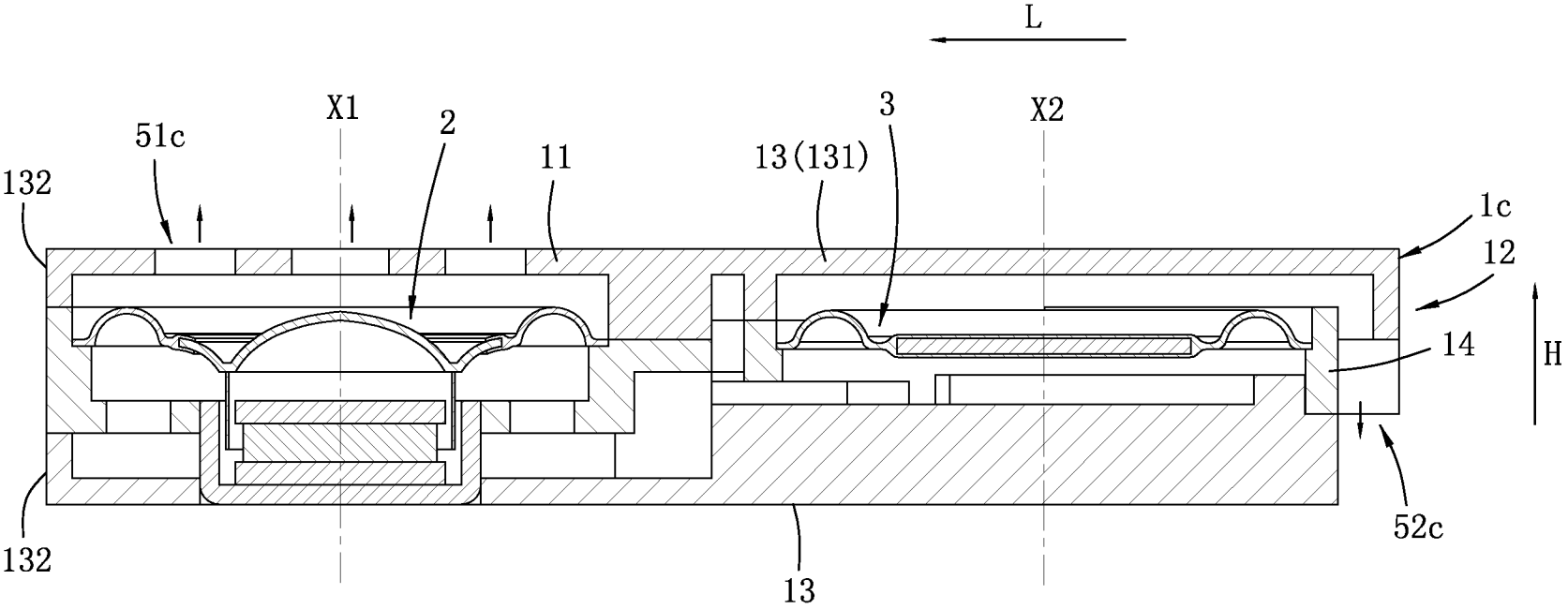
FIG. 8 is a sectional view of a fourth embodiment of the speaker device.

Referring further to FIGS. 8, a fourth embodiment of the speaker device 100 includes a different configuration of the housing body 1*c*, and has a configuration of the first sound hole 51*c* being the same as that in the second embodiment, and a different configuration of the second sound hole 52*c*. In addition, the speaker driver 2 and the passive radiator 3 in the fourth embodiment face the same one of the shell covers 13 of the housing body 1*c*. In the fourth embodiment, the shell wall 131 of the one of the shell covers 13 that the speaker driver 2 and the passive radiator 3 face is formed with the first sound hole 51*c* opening in the second direction (H). The dimension of the one of the shell covers 13 having the first sound hole 51*c* is greater than that of the other one of the shell covers 13 and that of the mounting base 14 in the first direction (L). The shell surrounding 132 of the one of the shell covers 13 has two opposite ends in the first direction (L). By virtue of the greater dimension of the one of the shell covers 13 in the first direction (L), one end of the shell surrounding 132 of the shell cover 13 is misaligned from the mounting base 14 and the other one of the shell covers 13 in the second direction (H). The one end of the shell surrounding 132 of the one of the shell covers 13 cooperates with the mounting base 14 to define the second sound hole 52*c* opening in a direction opposite to the second direction (H). That is to say, the first sound hole 51*c* is formed at the one of the wall section 11 of the housing body 1*c* that the speaker driver 2 and the passive radiator 3 face, and the second sound hole 52*c* is formed at the surrounding section 12 of the housing body 1*c*. With the configurations of the first sound hole 51*c* and the second sound hole 52*c*, the sound that is generated by the speaker driver 2 travels through the first sound hole 51*c* in the direction parallel to the direction in which the central axis (X1) of the speaker driver 2 extends, and the sound that is generated by the passive radiator 3 travels through the second sound hole 52*c* in the direction parallel to the direction in which the central axis (X2) of the passive radiator 3 extends.

Figure 9:
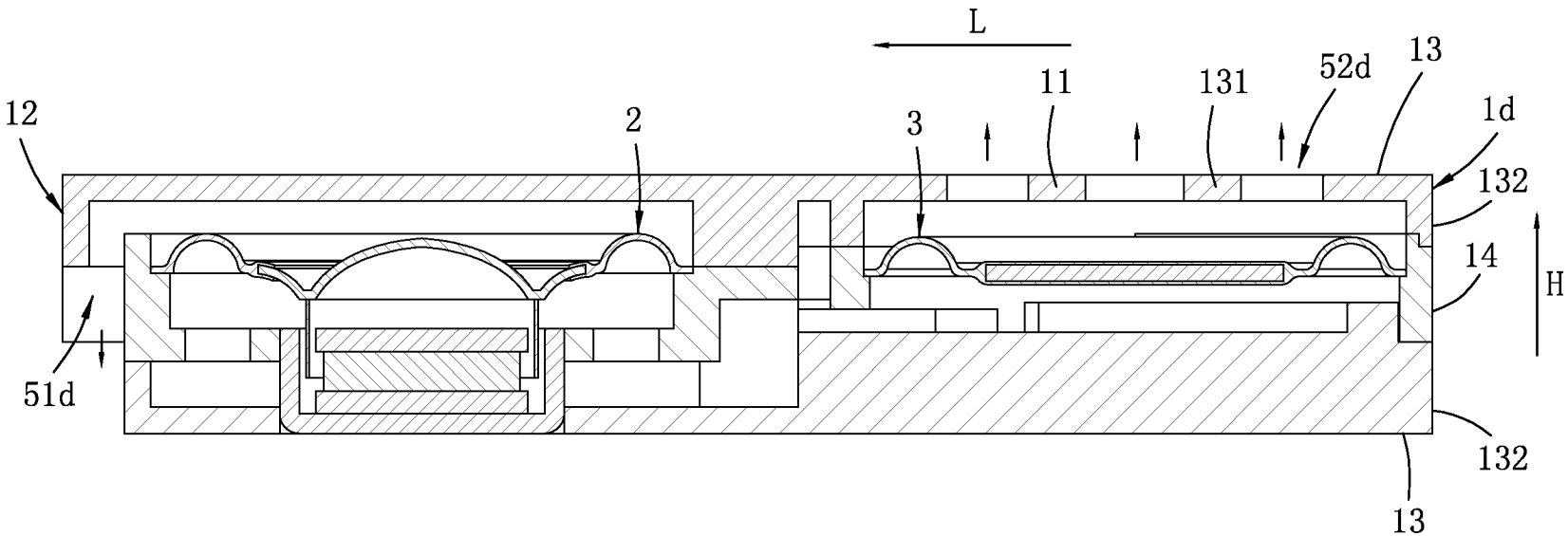
FIG. 9 is a sectional view of a fifth embodiment of the speaker device.

Referring further to FIGS. 9, a fifth embodiment of the speaker device 100 similar to the fourth embodiment includes a different configuration of the one the shell covers 13 of the housing body 1*d* that the speaker driver 2 and the passive radiator 3 face, and has different configurations of the first sound hole 51*d* and the second sound hole 52*d*. In the fifth embodiment, the shell wall 131 of the one of the shell covers 13 that the speaker driver 2 and the passive radiator 3 face is formed with the second sound hole 52*d* opening in the second direction (H). The dimension of the one of the shell covers 13 having the second sound hole 52*d* is greater than that of the other one of the shell covers 13 and that of the mounting base 14 in the first direction (L). By virtue of the greater dimension of the one of the shell covers 13 in the first direction (L), the other one end of the shell surrounding 132 of the shell cover 13 is misaligned from the mounting base 14 and the other one of the shell covers 13 in the second direction (H). The other one end of the shell surrounding 132 of the one of the shell covers 13 cooperates with the mounting base 14 to define the first sound hole 51*d* opening in the direction opposite to the second direction (H). That is to say, the second sound hole 52*d* is formed at the one of the wall section 11 of the housing body 1*d* that the speaker driver 2 and the passive radiator 3 face, and the first sound hole 51*d* is formed at the surrounding section 12 of the housing body 1*d*.

In summary, by virtue of the first sound hole 51 and the second sound hole 52 respectively opening in the opposite directions, constructive interference instead of phase cancellation occurs, which improves the low-frequency audio performance of the speaker device 100. Moreover, by virtue of the longest dimension (A1) being no less than three times the shortest dimension (A2), and by virtue of the ratio of the volume of the speaker driver 2 to that of the through space 10 ranging from 1:2 to 2:1, the speaker driver 2 and the passive radiator 3 can not only be well disposed in the housing body 1 but also provide relatively good audio performance even though the size of the speaker device 100 may be relatively small.

In the description above, for the purposes of explanation, numerous specific details have been set forth in order to provide a thorough understanding of the embodiments. It will be apparent, however, to one skilled in the art, that one or more other embodiments maybe practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what are considered the exemplary embodiments, it is understood that this disclosure is not limited to the disclosed embodiments but is intended to cover various arrangements included within the spirit and scope of the broadest interpretation so as to encompass all such modifications and equivalent arrangements.

What is claimed is:

1. A speaker device comprising:

a housing body formed with a first sound hole and a second sound hole that respectively open in two opposite directions;

a speaker driver disposed in said housing body, located adjacent to said first sound hole, and adapted to generate sound; and a passive radiator disposed in said housing body, located adjacent to said second sound hole, and adapted to generate sound, said first sound hole and said second sound hole being adapted for respectively allowing the sound generated by said speaker driver and the sound generated by said passive radiator to travel out from said housing body respectively in two opposite directions therethrough, wherein said speaker driver has a central axis extending in a direction perpendicular to the direction in which the sound that is generated by said speaker driver travels through said first sound hole.

2. The speaker device as claimed in claim 1, wherein said housing body has two wall sections located at two opposite sides of said speaker driver and said passive radiator, said first sound hole and said second sound hole being respectively formed at said wall sections.

3. The speaker device as claimed in claim 1, wherein said housing body has two wall sections located at two opposite sides of said speaker driver and said passive radiator, and a surrounding section surrounding said speaker driver and said passive radiator, and interconnecting said wall sections, said first sound hole and said second sound hole being formed at said surrounding section.

4. The speaker device as claimed in claim 1, wherein said housing body has two wall sections located at two opposite sides of said speaker driver and said passive radiator, and a surrounding section surrounding said speaker driver and said passive radiator, and interconnecting said wall sections, one of said first sound hole and said second sound hole being formed at one of said wall section, the other one of said first sound hole and said second sound hole being formed at said surrounding section.

5. The speaker device as claimed in claim 1, wherein said housing body has a longest dimension in a first direction and a shortest dimension in a second direction different from the first direction, the longest dimension being no less than three times the shortest dimension.

6. The speaker device as claimed in claim 1, wherein said housing body defines a through space located substantially between said speaker driver and said passive radiator, a ratio of volume of said speaker driver to that of said through space ranging from 1:2 to 2:1.

7. The speaker device as claimed in claim 6, wherein:

said housing body further defines a first disposing space at which said speaker driver is located, and a second disposing space at which said passive radiator is located, a portion of said first disposing space serving as a portion of said through space, a portion of said second disposing space serving as another portion of said through space; and a rear side of said speaker driver faces said through space, and a rear side of said passive radiator faces said through space.

8. The speaker device as claimed in claim 1, wherein said passive radiator has a central axis extending in a direction perpendicular to the direction in which the sound that is generated by said passive radiator travels through said second sound hole.

9. The speaker device as claimed in claim 1, wherein said passive radiator has a central axis extending in a direction parallel to the direction in which the sound that is generated by said passive radiator travels through said second sound hole.

10. A speaker device comprising:

a housing body formed with a first sound hole and a second sound hole, and including two shell covers and a mounting base disposed between said shell covers, each of said shell covers having a shell wall and a shell surrounding that extends from a periphery of said shell wall, said shell surrounding of one of said shell covers cooperating with said mounting base to define one of said first sound hole and said second sound hole, said first sound hole and said second sound hole respectively opening in two opposite directions;

a speaker driver mounted to said mounting base, located adjacent to one of said first sound hole and said second sound hole, and adapted to generate sound; and a passive radiator mounted to said mounting base, located adjacent to the other one of said first sound hole and said second sound hole, and adapted to generate sound, the one and the other one of said first sound hole and said second sound hole being adapted for respectively allowing the sound generated by said speaker driver and the sound generated by said passive radiator to travel out from said housing body respectively in two opposite directions therethrough.

11. The speaker device as claimed in claim 10, wherein said shell surrounding of the other one of said shell covers cooperates with said mounting base to define the other one of said first sound hole and said second sound hole.

12. The speaker device as claimed in claim 10, wherein said shell surrounding of the one of said shell covers further cooperates with said mounting base to define the other one of said first sound hole and said second sound hole.

13. The speaker device as claimed in claim 10, wherein the other one of said first sound hole and said second sound hole is formed at said shell wall of one of said shell covers of said housing body.

14. A speaker device comprising:

a housing body including two shell covers each of which has a shell wall, said shell walls of said shell covers being respectively formed with a first sound hole and a second sound hole that respectively open in two opposite directions;

a speaker driver disposed in said housing body, located adjacent to one of said first sound hole and said second sound hole, and adapted to generate sound; and a passive radiator disposed in said housing body, located adjacent to the other one of said first sound hole and said second sound hole, and adapted to generate sound, the one and the other one of said first sound hole and said second sound hole being adapted for respectively allowing the sound generated by said speaker driver and the sound generated by aid passive radiator to travel out from said housing body respectively in two opposite directions therethrough.

* * * * *